United States Patent [19]

Guibleo

[11] Patent Number: 5,000,494

[45] Date of Patent: Mar. 19, 1991

[54] RECESSED DOOR HANDLE

[76] Inventor: Robert Guibleo, P.O. Box 581, Piscataway, N.J. 08854

[21] Appl. No.: 512,136

[22] Filed: Apr. 18, 1990

[51] Int. Cl.[5] ..... E05C 1/04

[52] U.S. Cl. ..... 292/148; 292/DIG. 68

[58] Field of Search ..... 292/DIG. 18, DIG. 68, 292/DIG. 38, DIG. 31, 148, 337, 244; 70/129

[56] References Cited

U.S. PATENT DOCUMENTS

| | | | |
|---|---|---|---|
| 2,825,219 | 3/1958 | Marzillier | 292/DIG. 68 |
| 2,912,271 | 11/1959 | Schaffer | 292/148 |
| 2,946,640 | 7/1960 | Sitler | 292/DIG. 68 |
| 3,374,020 | 3/1968 | Berg | 292/148 |
| 3,866,961 | 2/1975 | List | 292/148 |
| 4,321,812 | 3/1982 | Pelcin | 292/DIG. 31 |
| 4,573,722 | 3/1986 | Lyng | 292/148 |
| 4,782,675 | 11/1988 | Thorburn | 292/148 |
| 4,841,755 | 6/1989 | Weinerman et al. | 292/DIG. 31 |

FOREIGN PATENT DOCUMENTS

| | | | |
|---|---|---|---|
| 1463128 | 11/1966 | France | 292/148 |
| 2039320 | 8/1980 | United Kingdom | 292/148 |

*Primary Examiner*—Eric K. Nicholson

*Attorney, Agent, or Firm*—Howard R. Popper

[57] ABSTRACT

A recessed door latch suitable for use in a gymnasium locker door is disclosed which includes a horizontal slide bolt mounted between two deep-drawn nested and flanged dishes which are advantageously fabricated of high-strength thermoplastic such as a polycarbonate. The slide bolt, which also may be fabricated of such plastic, is provided with a groove that mates with a rib projecting from one of the dishes. The deck portion of one of the plastic dishes includes a pair of knock-out plates either of which may be removed to accommodate the articulated handle of the slide bolt.

8 Claims, 4 Drawing Sheets

RECESSED DOOR HANDLE

TECHNICAL FIELD

This invention relates to door handles and, more particularly, to a recessed door handle for use as original equipment or as a replacement handle for locker doors of the type used in gymnasiums.

BACKGROUND ART

A popular form of gymnasium wardrobe or locker consists of a sheet metal frame and a hinged, lockable door. Two latching mechanisms were available for securing the locker door closed. The prior art two- or three-point latch utilized a long vertical bar attached to a lift handle while the single-point system utilized a horizontal slide bolt. The scarcity of replacement parts for the plural point locking systems has seen these types being replaced by the horizontal slide bolt type of latching system. Although the slide bolt locking system is itself quite old, as exemplified by French patent 1,463,128, Nov. 9, 1965, the construction shown in the more recently issued patent of W. E. Lyng, Pat. No. 4,573,722, Mar. 4, 1986 is more commonly encountered. Both the French patent and the Lyng patent use a horizontally slidable, sheet metal bolt.

While both these prior art sheet metal slide bolts are designed to slide horizontally, the French patent's slide bolt is oriented to present its width at right angles to the door jamb while the width of the slide bolt in the Lyng patent is parallel to the door jamb. The right-angle orientation offers greater resistance to bending when the handle is forced than the parallel orientation. However because most locker doors and door jambs are not deep enough to accommodate a sheet metal slide bolt of substantial width, this type has not been widely employed in the replacement market. On the other hand, the vertically disposed width of the Lyng patent's slide bolt requires the use of two spaced-apart sheet metal sections which must be joined together at their ends in order to offer a sufficient moment of inertia or resistance against bending when the handle is tampered with. While the Lyng patent has achieved a certain amount of success, the need to fabricate all of its parts, especially the slide bolt, from sheet metal requires a number of costly manufacturing steps and additional finishing steps such as painting or plating.

The most common method of locking the lift handle on slide bolts of the prior art was to provide the slide bolt or lift handle with an aperture through which the shackle of the combination lock could be passed. It would be advantageous to provide a replacement latching system that could be used with either the U-shackle type of combination lock or with the permanently installed-type of combination lock.

DISCLOSURE OF THE INVENTION

In accordance with the principles of my invention, a recessed, lockable latch for a locker door is provided by employing a single, slide bolt of substantial cross-section, slidably mounted in the space provided between two deep-drawn, nested dishes that are secured to a cut-out in the locker door. The rearward dish advantageously includes a horizontal guide rib which engages a channel in the rear face of the slide bolt. The mid-front face of the bolt is articulated to provide a handle that can be passed through either of two knock-out slots in the front dish to accommodate left- or right-hand door latches. A staple is mounted between the two knock-out slots to receive the shank of the padlock which may be passed through an aperture in the articulated handle.

It is an aspect of my invention that at least one of the two dishes and the slide bolt be fabricated of injection-moldable, high strength thermoplastic material such as a polycarbonate. Alternatively a 20% glass-filled thermoplastic resin may be employed. In addition, the slide bolt may be provided with a recess to accommodate the tongue of a combination lock permanently affixed to the front dish.

BEST MODE FOR CARRYING OUT THE INVENTION

Figure 2:
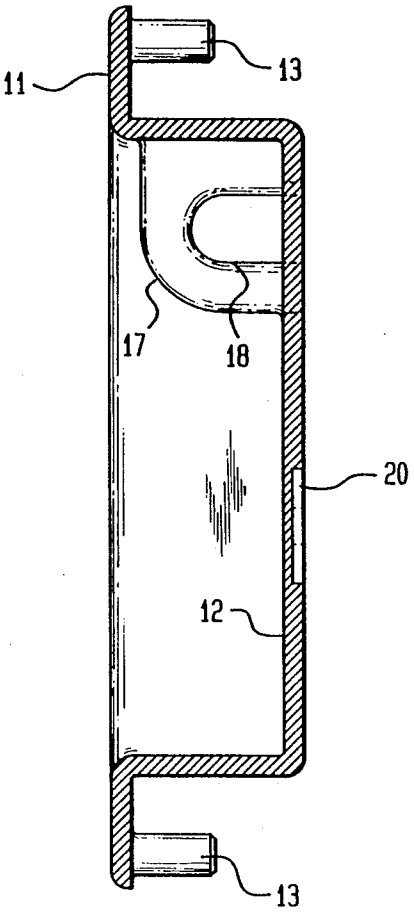
FIG. 2 shows a section view through the forward dish.
Figure 1:
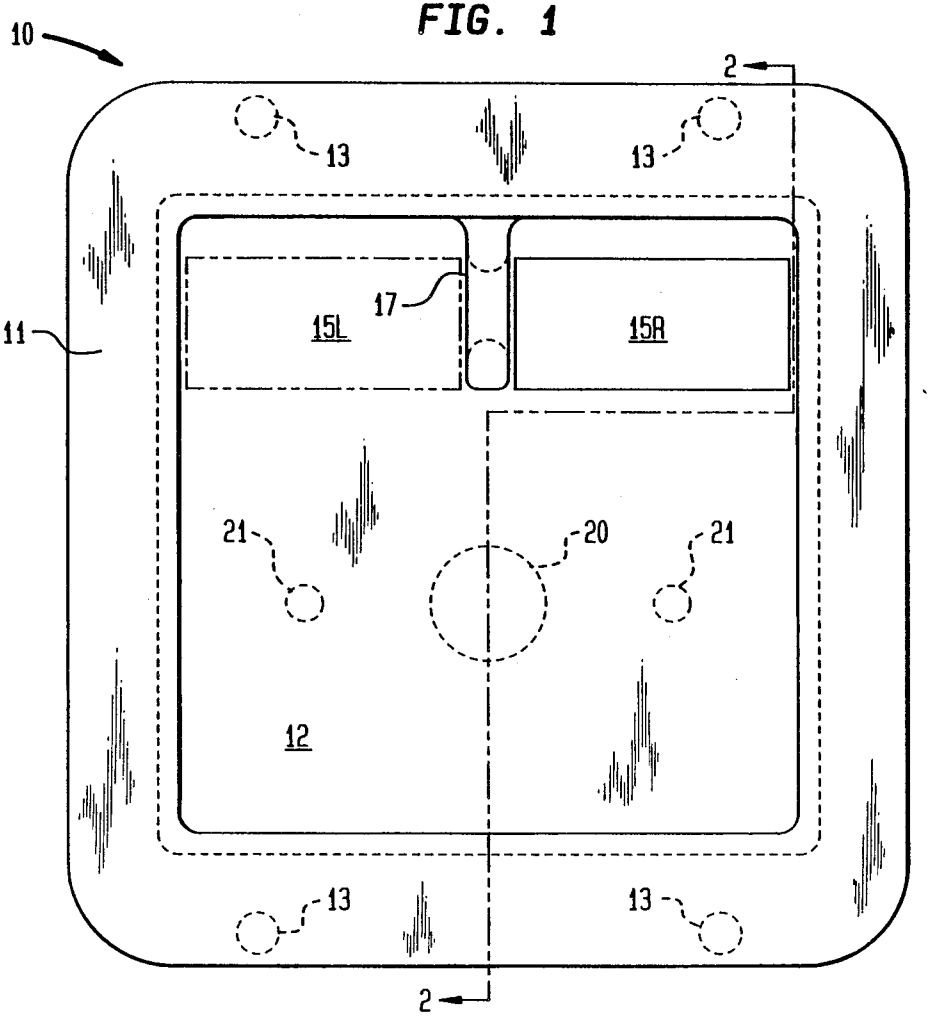
FIG. 1 shows a front plan view of the forward dish of my invention.

Referring now to FIGS. 1 and 2, there is shown the forward dish 10 in front and sectional views, respectively. Dish 10 includes a circumferential flange 11 and a deep drawn deck plate 12. Flange includes a plurality of appropriately-spaced mounting ferrules 13 on its rear face for securing dish 10 to the sheet metal lower door (not shown). Deck 12 is displaced from flange 11 by a depth sufficient to accommodate the depth of a combination lock (not shown) such that all such parts will lie below the plane of flange 11 to effect a "flush mounted" door handle. The upper portion of deck 12 includes two rectangular knock-out segments 15L and 15R, disposed at either side of staple 17. The aperture 18 is provided for receiving the shank of a combination lock (not shown). The lower mid-portion of deck 12 is provided with a circular knock-out 20 and mounting holes 21 for accommodating a permanently mounted type of combination lock.

Figure 3:
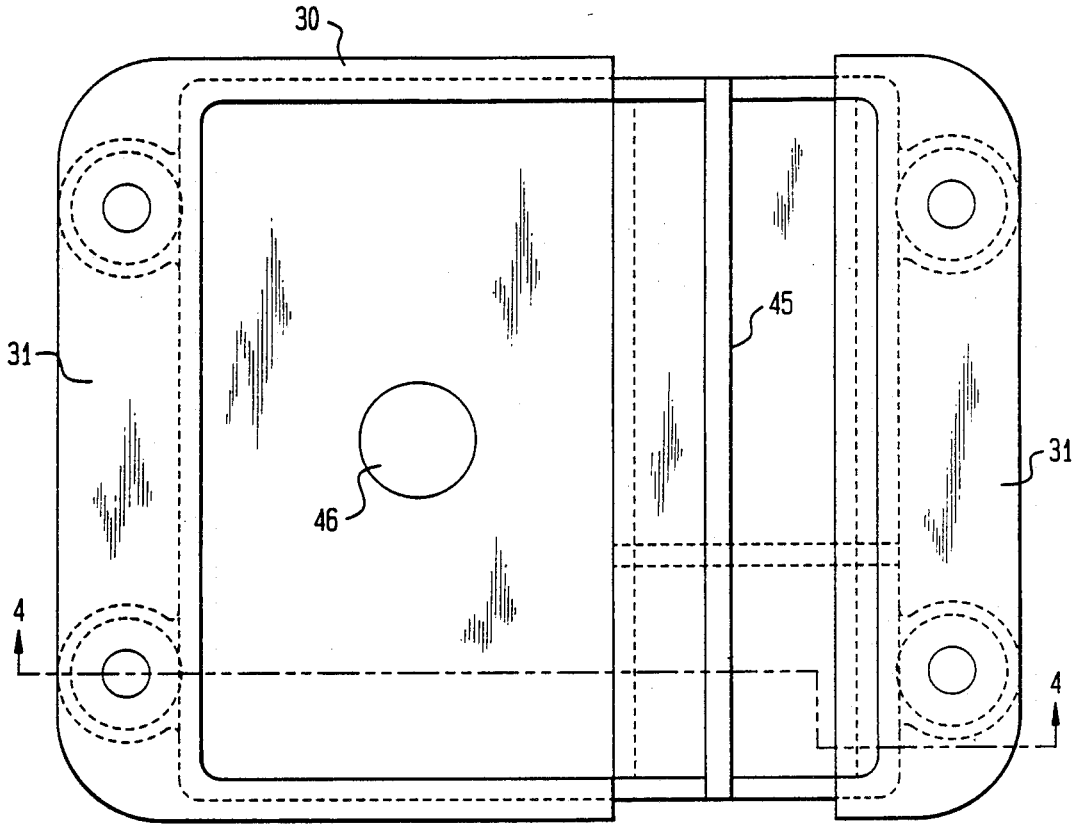
FIG. 3 shows a front plan view of the rearward dish.
Figure 4:
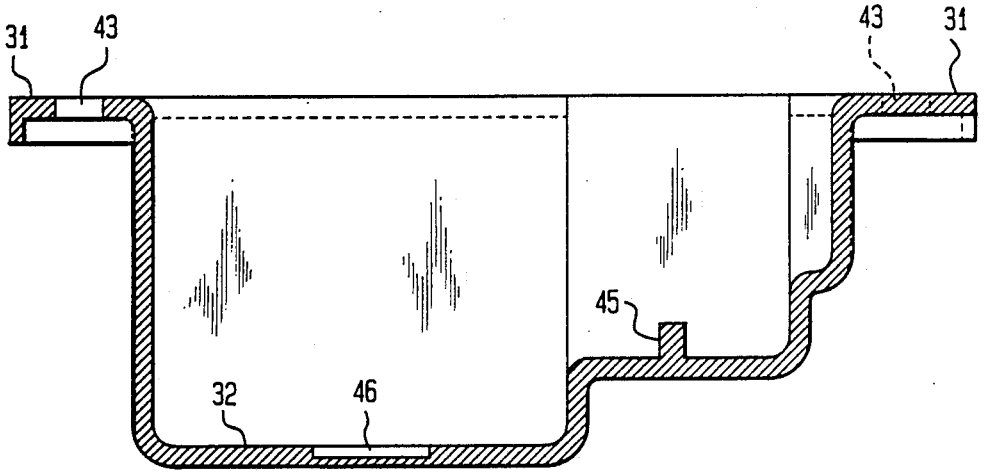
FIG. 4 shows a sectional view through the rearward dish.

Referring now to FIGS. 3 and 4, there is shown the rearward dish 30 of my invention which includes the peripheral flange 31 and a deep drawn deck 32. Deck 32 is displaced from flange 31 by a depth sufficient to accommodate the slide bolt 50 (see FIG. 5) as well as the barrel and locking tongue of the built-in type of combination lock (shown in dotted outline in FIG. 4). The flange 31 includes a plurality of spaced clearance holes 43 which are in registration with the protruding ferrules 13 of the front dish (FIG. 2). When dish 10 and dish 30 are nested together, ferrules 13 are to be in registration with corresponding clearance holes in the locker door (not shown). Self-threading speed nuts may then be made up on ferrules 13 to secure the nested dishes to the locker door.

The upper front portion of deck 32 includes a transverse rib 45 which is designed to engage the rear channel 51 of slide bolt 50. The lower portion of deck 32 includes a knock-out portion 46 to accommodate the entry of a setting key (not shown) that may be used to alter the combination of the permanently installed type of combination lock (not shown).

Figure 6:
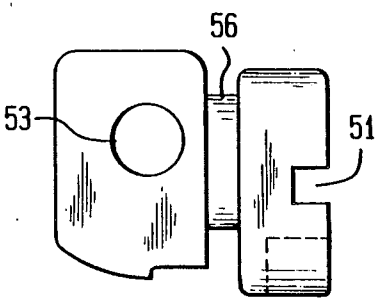
FIGS. 5, and 6 show front and sectional views of the slide bolt of my invention.
Figure 5:
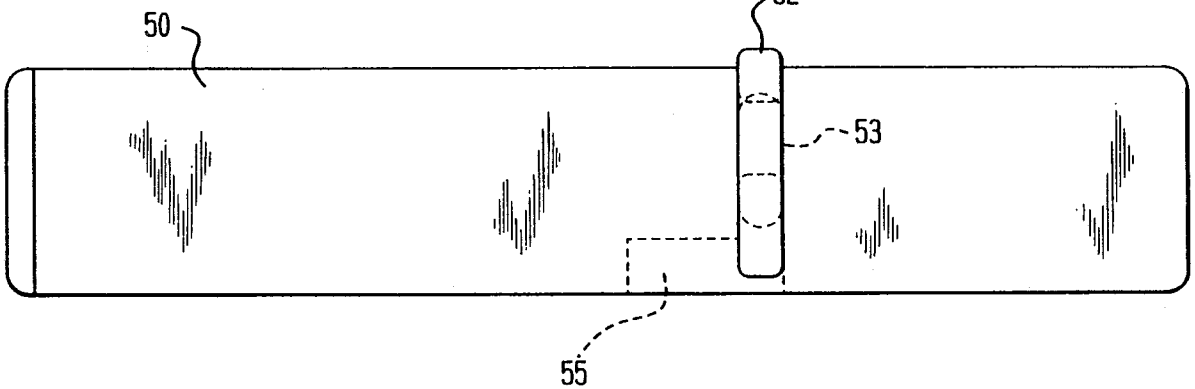
Figure 7:
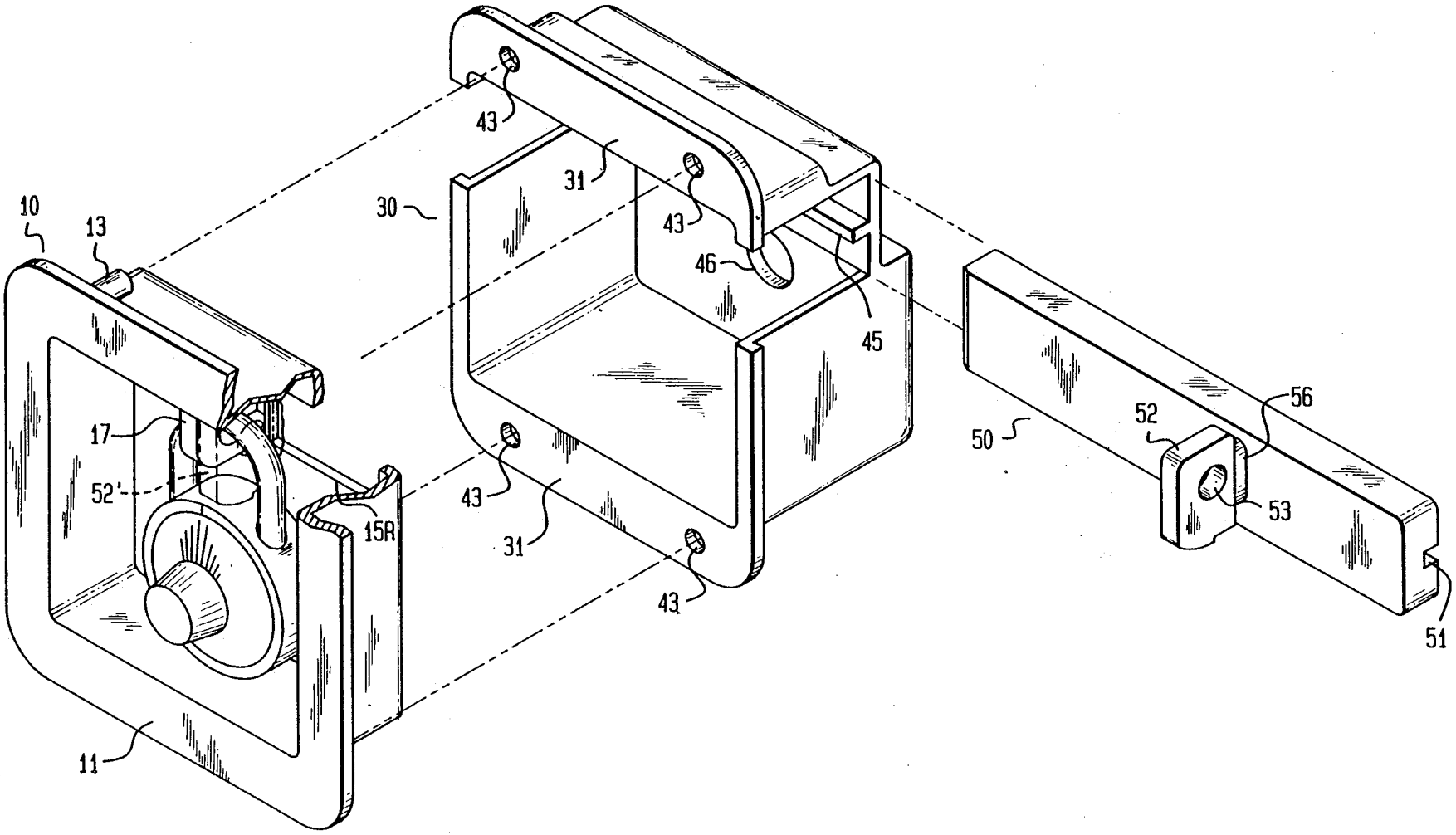
FIG. 7 shows an isometric view of the assembled recessed handle of my invention.

Referring now to FIGS. 5 and 6, there is shown a front and sectional view through the bolt 50. The rear of bolt 50 is provided with a channel 51 extending through its length. The front face of bolt 50 is provided with an articulated handle 52 that includes an aperture 53 through which the shackle of a combination lock may be passed. The lower portion of the bolt is provided with a recess 55 to accommodate the tongue of a built-in combination lock. Articulated handle 52 includes a neck portion 56 whose vertical dimension is slightly smaller than the vertical dimension of knock-out 15L or 15R of front dish 10 and whose depth is slightly greater than the wall thickness of front dish 10. Neck portion 56 allows the bolt 50 to be loosely captured within the rectangular space defined by one of knockouts 15L or 15R during pre-assembly with front dish 10 just before the nesting of front dish 10 with rear dish 30.

When the recessed door handle of my invention is installed on the locker door, rear dish 30 is positioned in the cut-out provided in the locker door (not shown). Knock-out 15L or 15R will be removed from the front dish depending upon whether the locker door is left- or right-handed. Bolt 50 will be positioned so that its articulated handle 52 protrudes through the rectangular opening provided by knock-out 15L or 15R, neck portion 56 being captured by front dish 10. Front dish 10 is then nested onto rear dish 30 so that rib 45 of dish 30 engages rear channel 51 of bolt 50. Ferrules 13 of front dish 10 are positioned to be in registration with clearance holes 43 of rear dish 30 and the clearance holes of the locker door (not shown). When dish 10 and dish 30 are nested together, self-threading speed nuts or other suitable fasteners (not shown) may then be made up on ferrules 13 to secure the nested dishes to the locker door.

The front dish 10, rear dish 30 and slide bolt 50 may each advantageously be fabricated of high strength thermoplastic such as a polycarbonate or a 20% glass filled composition. In one illustrative embodiment, the flanges 11 of dish 10 have outer dimensions of approximately 5"×5", deck 12 is approximately 3 7" by 3.7" and is spaced approximately 1" from flange 11. The wall thickness of dish 10 and dish 30 are each approximately $\frac{1}{8}$".

The foregoing is illustrative of the principles of my invention; various modifications will be apparent to those skilled in the art without, however, departing from the spirit and scope of my invention.

What is claimed is:

1. A recessed, lockable latch for mounting in the cut-out of a locker door, comprising:

a pair of deep-drawn, nested dishes each having a deck portion and a flange portion, said deck portions being smaller and said flange portions being larger than said locker door cut-out, a slide bolt slidably mounted between said deck portions of said nested dishes, said bolt and one of said deck portions having mating channel and rib segments, said bolt having an articulated handle at its mid-point, and said deck portion of one of said nested dishes having a pair of rectangular knock-out plates either of which may be removed to accommodate said handle.

2. A recessed latch according to claim 1 wherein said rib of said channel and rib segments is substantially the same length as said channel.

3. A recessed latch according to claim 1 wherein said one of said dishes includes a staple positioned between said rectangular knock-out plates.

4. A recessed latch according to claim 1 wherein said bolt includes a notch for receiving the tongue of a lock to restrain said bolt from sliding.

5. A recessed latch according to claim 1 wherein at least one of said nested dishes is fabricated of high-strength thermoplastic.

6. A recessed latch according to claim 5 wherein said thermoplastic is a polycarbonate.

7. A recessed latch according to claim 2 wherein said bolt is fabricated of high-strength polycarbonate.

8. A recessed, lockable latch for mounting in the cut-out of a locker door, comprising:

a pair of deep-drawn, nested dishes each having a deck portion and outwardly extending flange portions, one of said deck portions having an integral transverse rib facing the other of said deck portions, a slide bolt slidably mounted between said deck portions of said nested dishes, said bolt having an integral channel for accepting said transverse rib of said deck, said rib supporting said bolt through substantially the full length of its traverse.

* * * * *